US011400471B2

(12) United States Patent
Shimakura et al.

(10) Patent No.: US 11,400,471 B2
(45) Date of Patent: Aug. 2, 2022

(54) AIRLESS CONTAINER

(71) Applicants: KITANO CO., LTD., Toyama (JP); KAKEN PHARMACEUTICAL CO., LTD., Tokyo (JP)

(72) Inventors: Katsunori Shimakura, Toyama (JP); Masayoshi Takaoka, Fujieda (JP); Tatsuro Nagao, Fujieda (JP)

(73) Assignees: KITANO CO., LTD., Toyama (JP); KAKEN PHARMACEUTICAL CO., LTD., Tokyo (JP)

( * ) Notice: Subject to any disclaimer, the term of this patent is extended or adjusted under 35 U.S.C. 154(b) by 0 days.

(21) Appl. No.: 17/264,764

(22) PCT Filed: Sep. 3, 2018

(86) PCT No.: PCT/JP2018/032596
§ 371 (c)(1),
(2) Date: Jan. 29, 2021

(87) PCT Pub. No.: WO2020/049612
PCT Pub. Date: Mar. 12, 2020

(65) Prior Publication Data

US 2021/0291211 A1 Sep. 23, 2021

(51) Int. Cl.
*B05B 11/00* (2006.01)

(52) U.S. Cl.
CPC ..... *B05B 11/00416* (2018.08)

(58) Field of Classification Search
CPC ..... B05B 11/0048; B05B 11/0037; B05B 11/3001; B05B 11/00416; B05B 11/0038; B05B 15/14
(Continued)

(56) References Cited

U.S. PATENT DOCUMENTS 3,377,003 A * 4/1968 Bacon ..... B65D 83/64 222/386
3,421,664 A * 1/1969 Eichberg ..... B65D 83/64 222/340
(Continued)

FOREIGN PATENT DOCUMENTS

JP H08268460 A 10/1996
JP H08282708 A 10/1996
(Continued)

OTHER PUBLICATIONS

JP2008162669 with Machine Translation (Year: 2008).*
(Continued)

*Primary Examiner* — Vishal Pancholi
(74) *Attorney, Agent, or Firm* — Holtz, Holtz & Volek PC

(57) ABSTRACT

An airless container includes a cylindrical container body storing a contained material, which is a fluid, in an airtight state, and a pump attached to an upper edge portion of the container body and configured to externally discharge the contained material. The airless container further includes a bottom lid that closes a lower opening portion of a container bottom portion of the container body, and a piston in the container body between the pump and the bottom lid, which is slidable in the container body in an airtight state. The piston includes a flexible piece that is deformable in a portion that comes into contact with the bottom lid. The flexible piece is deformable against the sliding of the piston toward the bottom lid.

2 Claims, 10 Drawing Sheets

(58) Field of Classification Search
USPC ..... 222/401
See application file for complete search history.

(56) References Cited

U.S. PATENT DOCUMENTS

| | | | | |
|---|---|---|---|---|
| 5,150,823 | A * | 9/1992 | Sugita | B05B 11/0056 222/386 |
| 9,370,790 | B2 | 6/2016 | Kim et al. | |
| 2009/0289083 | A1 | 11/2009 | Kamishita | |
| 2012/0267391 | A1 | 10/2012 | Yoo | |
| 2013/0140332 | A1* | 6/2013 | Csaszar | B05B 11/0008 222/256 |
| 2013/0193166 | A1 | 8/2013 | Decottignies et al. | |
| 2015/0217313 | A1 | 8/2015 | Kim et al. | |

FOREIGN PATENT DOCUMENTS

| | | | |
|---|---|---|---|
| JP | 2008162669 | A | 7/2008 |
| JP | 2010105683 | A | 5/2010 |
| JP | 2012116492 | A | 6/2012 |
| JP | 2013529093 | A | 7/2013 |
| JP | 2014221664 | A | 11/2014 |
| JP | 2015523292 | A | 8/2015 |
| WO | 2007123207 | A1 | 11/2007 |

OTHER PUBLICATIONS

JP2010105683 with Machine Translation (Year: 2010).*
JPH08268460 with Machine Translation (Year: 1996).*
International Preliminary Report on Patentability (IPRP) (and English language translation thereof) dated Mar. 9, 2021 issued in International Application No. PCT/JP2018/032596.
International Search Report (ISR) (and its English translation) dated Nov. 20, 2020 issued in International Application No. PCT/JP2018/032596.
Written Opinion dated Nov. 20, 2018 issued in International Application No. PCT/JP2018/032596.

* cited by examiner

AIRLESS CONTAINER

TECHNICAL FIELD

The present invention relates to an airless container in which discharging the contained fluid from a pump causes a piston disposed in a container body to rise while no air flows into the container space in the container.

BACKGROUND ART

Conventionally, as disclosed in Patent Literatures 1 to 3, an airless container has been used for storing a liquid, in which discharging a liquid by applying pressure to the liquid stored in the container causes the inside of the container to become negative pressure due to the discharge of the liquid, and causes a piston serving as a partition wall inside the container to rise by the volume of the discharged fluid to prevent any air to be newly introduced into a container space in the container.

In this type of airless container, the bottom lid of the container and the piston are adjacent to each other in a pre-use state, and when a large force is applied to the airless container due to the dropping of the container or the like, the bottom lid of the bottom portion of the container is removed by the piston, in some cases. Furthermore, when the container filled with a contained material is stored under a high-temperature environment, there are cases in which the pressure inside the container increases due to the expansion and/or vaporization of the contained material and causes the piston to be pushed down, causing the bottom lid to be removed in some cases.

Each container disclosed in Patent Literatures 1 to 3 is provided with a cushioning piece composed of an elastic material or a cushion absorbent integrated with the bottom lid in order to prevent the bottom lid from being removed due to an external impact. The cushioning piece or the cushion absorbent absorbs the impact on the bottom lid and prevents the bottom lid from being removed by coming into contact with the piston.

CITATION LIST

Patent Literature

Patent Literature 1: Japanese Unexamined Patent Publication No. 8-282708

Patent Literature: Japanese Unexamined Patent Publication No. 2012-116492

Patent Literature 3: Japanese Unexamined Patent Application Publication (Translation of PCT Application) No. 2015-523292

SUMMARY OF THE INVENTION

Problems to be Solved by the Invention

Each container in the above-described background art has a structure provided with a cushioning function through a cushioning piece composed of an elastic material or a cushion absorbent integrated with the bottom lid. The bottom lid is preferably composed of a hard material to securely fit to a container bottom portion. However, hard materials have a problem in that they do not readily elastically deform and have a small cushioning effect. When the bottom lid is composed of a soft material having a large cushioning effect, there is a problem in that the fitting strength with the container bottom portion is low and a rise in the inner pressure of the container due to a rise in the container temperature causes the bottom lid to readily be removed from the container. Therefore, improving the cushioning function of the bottom lid and preventing the bottom lid from being removed are contradictory issues.

Furthermore, when the bottom lid is composed of a material that is relatively harder than that of the piston, a large force, such as an impact, applied from the piston may cause the piston and the bottom lid to fit or adhere to each other. If the piston and the bottom lid fit or adhere to each other, the piston will be fixed. As a result, there is a risk during use that the piston will not slide upwards in the container with a slight force by negative pressure.

An object of the present invention, which has been made in view of the above-mentioned problems of the background art, is to provide an airless container in which the fitting strength between the container bottom portion and the bottom lid is high, and the bottom lid is not readily removed by an increase in pressure inside the container or an external impact.

Means for Solving the Problem

The present invention includes the following aspects.

[1] An airless container includes a cylindrical container body that defines a container space for storing a contained material in an airtight state, the contained material being a fluid; a pump that is attached to an upper edge portion of the container body and externally discharges the contained material; a bottom lid that closes an opening in the container bottom of the container body; and a piston disposed in the container body between the pump and the bottom lid and slidable in the container space in the container body in an airtight state, wherein a deformable portion is disposed on the bottom lid of the piston, and the deformable portion is operable to come into contact with the bottom lid and is deformable against the sliding of the piston toward the bottom lid.

[2] An airless container according to aspect [1], wherein the piston comprises a material that is relatively softer than the material of the bottom lid, and the deformable portion comprises at least one flexible piece that is integrally molded with the piston.

[3] An airless container according to aspect [2], wherein the at least one flexible piece comprises a plurality of flexible pieces, and the flexible pieces are disposed on a same circumference at equal intervals.

[4] An airless container according to aspect [2] or [3], wherein the at least one flexible piece readily tilts in one direction.

[5] An airless container according to aspect [4], wherein a tip portion of the at least one flexible piece has an end surface tilting relative to the vertical direction.

[6] An airless container according to any one of aspects [1] to [5], wherein the contained material comprises a liquid or a gel containing a solvent having high volatility or thermal expansion, or a preparation having ester bonds to an active ingredient, the volume of the container space in the container body is within a range of 25 to 100 mL, inclusive, and the ratio of a void remaining in the container space in the container body is 10% or less of the maximum volume of the container space in a state in which the piston and the pump are attached to the container body and the contained material is stored.

Effect of the Invention

The airless container of the present invention has a high fitting strength between the container bottom portion and the bottom lid, and the bottom lid is not readily removed even when the internal pressure rises due to a temperature rise of the container or when an external impact is applied. Furthermore, the piston and bottom lid do not fit or adhere to each other.

In the airless container according to an aspect of the present invention including a piston composed of a material that is relatively softer than that of the bottom lid, the piston does not fit or adhere to the bottom lid, and the structure of the airless container can be made to have high airtightness and liquid tightness as well as high fitting strength between the bottom lid and the container body.

Furthermore, the airless container of an aspect of the present invention in which a flexible piece is integrally molded with the piston can be readily manufactured at a lower cost. Moreover, the flexibility of the flexible piece causes the flexible piece to readily deform and certainly absorb the force applied to the bottom lid due to the sliding of the piston. This certainly prevents the bottom lid from being removed.

MODE FOR CARRYING OUT THE INVENTION

Each term in the present invention will now be explained below.

The term "fluid" in the description of the present invention refers to a liquid or a gel. The contained material in the airless container of the present invention is a fluid, for example, a preparation including water or alcohol. A preferred fluid is a liquid, a gel, or a lotion including a solvent having high volatility or thermal expansion, or a preparation having ester bonds to the active ingredient. The solvent is, for example, ethanol. When the contained material includes a solvent having high volatility or thermal expansion, the content of the solvent is preferably 30 mass % or more, more preferably 50 mass % or more, and further preferably 70 mass % or more.

According to an embodiment of the present invention, a "container body" has a cylindrical or elliptical cylindrical shape. The preferred container body has a cylindrical shape, and its diameter (the cross-section of the container body) is preferably within the range of 10 to 100 mm, inclusive, more preferably 20 to 50 mm, inclusive, and further preferably 30 to 45 mm, inclusive.

Figure 1:
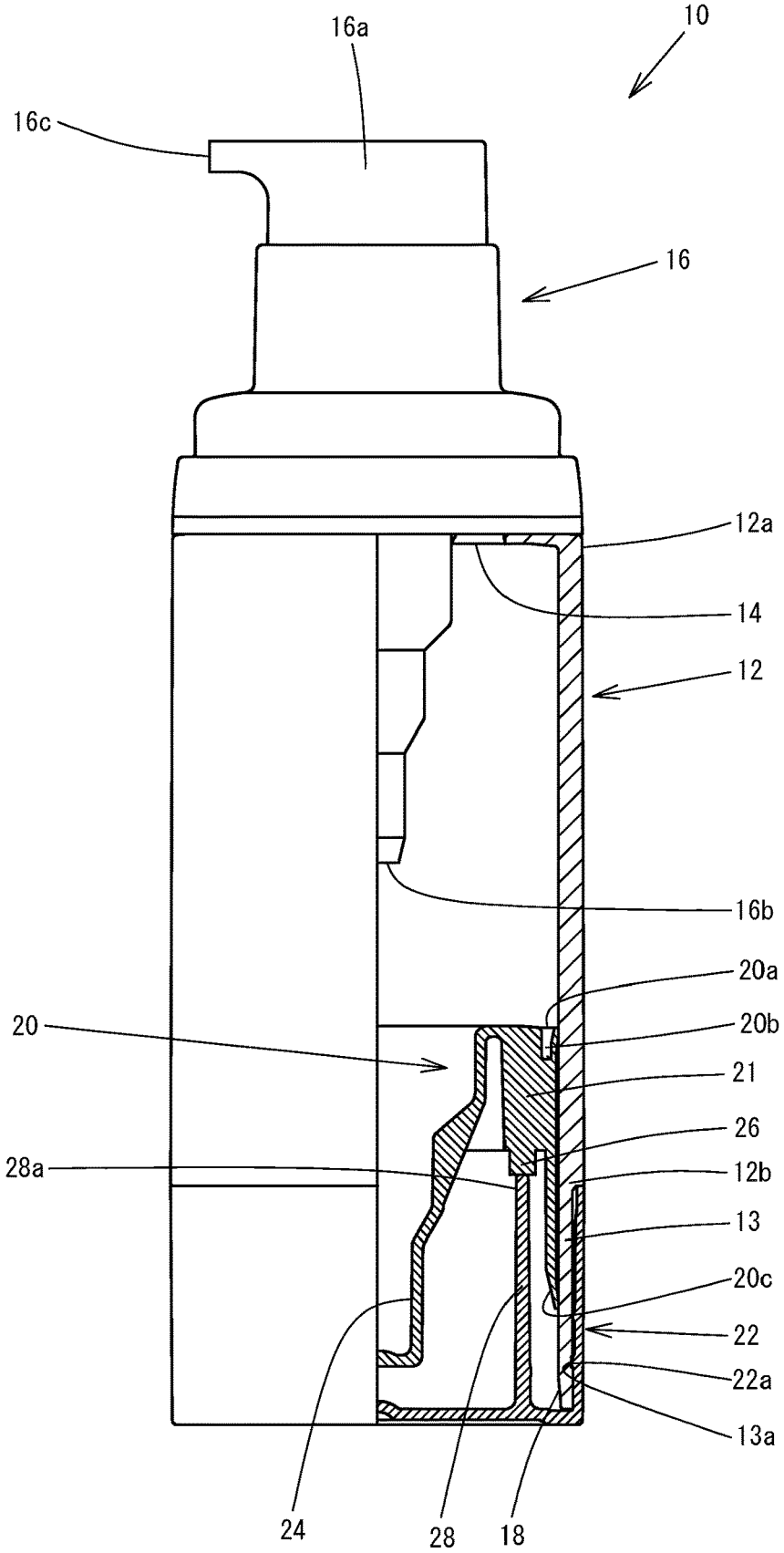
FIG. 1 is a partially cutaway front view of an airless container according to an embodiment of the present invention.
Figure 2:
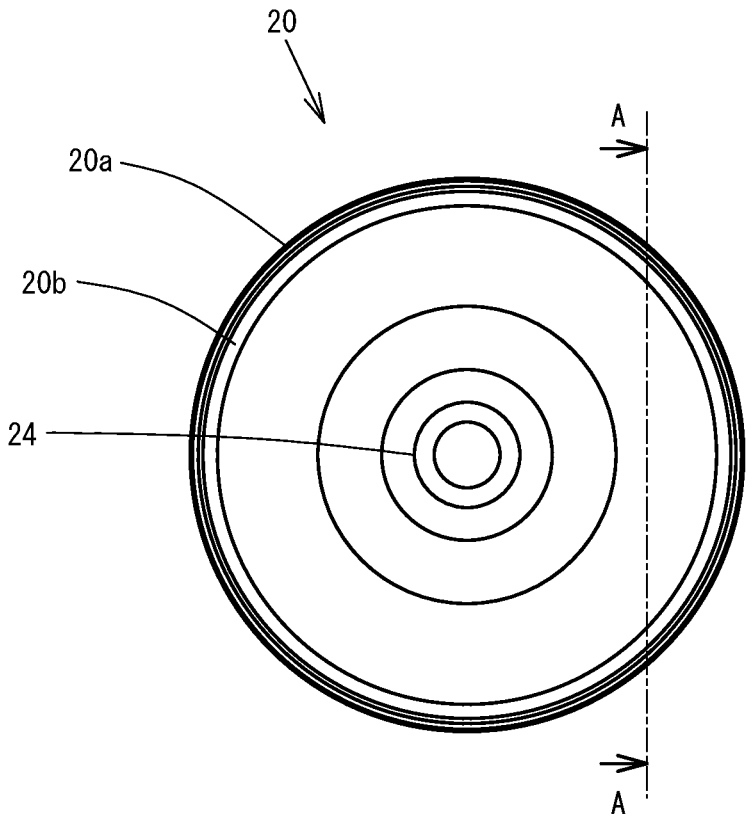
FIG. 2 is a plan view of a piston of the airless container of the embodiment.

Note that the terms "bottom," "up," "down," etc., in the description are used to refer to the position or direction when the airless container 10 is placed in the state illustrated in FIG. 1. The "vertical direction" coincides with the "up-down direction."

The term "pump" in the description refers to various types of pumps. For example, it includes a pump that externally discharges the contained material by a pressing operation.

The "piston" in the description is disposed in the container body between the pump and the bottom lid. The piston is disposed so that the piston can slide upwards inside the container body in an airtight state while the contained material is discharged from the pump.

According to an embodiment of the present invention, the container body, together with the piston and the pump, defines a container space for storing the contained material.

A bottom lid that closes an opening is coupled to the lower portion of the container body. When the container space reaches a maximum volume, the piston is disposed adjacent to the bottom lid at a lowest position without fitting or adhering to the bottom lid. At this time, the piston and the bottom lid are disposed adjacent to each other via deformable portions described below.

According to an embodiment of the present invention, the maximum volume of the container space is preferably 100 mL or less, more preferably within the range of 25 to 75 mL, inclusive, and further preferably 30 to 60 mL, inclusive.

According to an embodiment of the present invention, the ratio of a void to the maximum volume of the container space (hereinafter, also referred to as void ratio) while the contained material is being stored is preferably 20% or less, more preferably 10% or less, even more preferably 7% or less, further preferably 5% or less.

Note that, in the airless container according to the present invention, no air enters the container space inside the container before and after use (discharging of the contained material by the pump or sliding of the piston). Since the maximum volume of the container space is a value unique to the container, the void ratio does not change significantly before and after use.

The term "deformable portion" in the description refers to a deformable portion that is formed on the piston adjacent to the bottom lid so as to be able to come into contact with the bottom lid, and elastically flexes against the sliding of the piston toward the bottom lid as the internal pressure rises or the like. The "deformable portion" in the description elastically flexes but does not fit or adhere to the bottom lid. Therefore, the deformable portion does not affect the sliding of the piston.

According to an embodiment of the present invention, the deformable portion is a flexible piece disposed on the piston adjacent to the bottom lid, composed of the same material as the piston, and integrally molded with the piston. The preferred length of the flexible piece is not particularly limited, but is preferably within the range of 0.1 to 20 mm, inclusive, and more preferably 1 to 10 mm, inclusive.

According to an embodiment of the present invention, the deformable portion may be an elastically deformable elastic body that is disposed on the piston adjacent to the bottom lit so as to be able to come into contact with the bottom lid, and composed of a material different from that of the piston. The deformable portion (elastic body) in such a case is not particularly limited and may be composed of various resins, metals, etc., appropriately selected, as long as the deformable portion is formed of a material relatively softer than that of the bottom lid, and the piston and the bottom lid do not fit or adhere to each other. For example, the deformable portion may be a single circular elastic body (rubber material) disposed on the piston adjacent to the bottom lid.

From the viewpoint of manufacturing cost, it is preferred that the flexible piece be integrally molded with the piston at a position adjacent to the bottom lid.

A plurality of the flexible pieces or elastic bodies may be disposed on the piston adjacent to the bottom lid. For example, it is preferred that four or more flexible pieces or elastic bodies be provided. In such a case, it is preferred that the flexible pieces or elastic bodies be disposed on the same circumference at equal intervals.

According to an embodiment of the present invention, when the deformable portion is a flexible piece integrally molded with the piston, it is preferred that the flexible piece have a tip portion having an end face tilting relative to the vertical direction. As a result, the flexible piece can elastically deform by tilting in one direction.

Embodiments of the present invention will now be described with reference to the drawings.

FIGS. 1 to 5 illustrate an airless container 10 according to an embodiment of the present invention. The material contained in the airless container 10 of this embodiment is a fluid, for example, a liquid or a gel including ethanol as a solvent.

As illustrated in FIG. 1, the airless container 10 of this embodiment includes a cylindrical container body 12 open at the upper and lower ends. The container body 12 is formed of metal or resin in a cylindrical shape, but the container body 12 may be appropriately be modified so that it is formed in an elliptical cylindrical shape. The diameter (cross-section of the container body) of the container body 12 is 36 mm, but the diameter may be appropriately changed as long as the effect of the present invention is not impaired. The diameter of the container body of the airless container of the present invention is preferably within the range of 10 to 100 mm, inclusive, more preferably 20 to 50 mm, inclusive, and further preferably 30 to 45 mm, inclusive.

An upper opening portion 14 of an upper edge portion 12*a* of the container body 12 is formed in a circular shape having a diameter smaller than that of the container body 12. A pump 16 is attached to the upper opening portion 14 to close the upper opening portion 14. The pump 16 externally discharges the contained material by a pressing operation, but the pump 16 may be changed to any type of pump. A piston 20 is disposed inside the container body 12 in a freely slidable manner. The piston 20 is disposed inside the container body 12 between the pump 16 and the bottom lid 22 described below. As described below, the piston 20 is able to slide upward inside the container body 12 in an airtight state by negative pressure caused by the pump 16 discharging the contained material. A fitting recess 13 having a slightly smaller outer diameter is disposed in a cylindrical shape from a lower opening portion 18 on the entire circumference of a container bottom portion 12*b* of the container body 12. A bottom lid 22 is fitted to the fitting recess 13 of the container bottom portion 12*b* to close the lower opening portion 18.

The piston 20 and the pump 16 are attached to the container body 12 to define a container space for storing the contained material. When the container space has a maximum volume, the piston 20 is positioned at the bottom, and in this state, the bottom lid 22 and the piston 20 are vertically adjacent to each other. In the airless container 10 of this embodiment, the maximum volume of the container space is 53 mL, but the volume may be appropriately changed as long as the effect of the present invention is not impaired. The maximum volume of the container space of the airless container in the present invention is preferably 100 mL or less, more preferably within the range of 25 to 75 mL, inclusive, and further preferably 30 to 60 mL, inclusive.

In response to a pressing operation of a head portion 16*a* of the pump 16, the pump 16 is able to suck the liquid or the like, which is the contained material, from a suction port 16*b* in the bottom portion, and discharge the fluid, which is a liquid or the like, stored inside the container body 12 from a discharge portion 16*c* in the upper edge portion. The internal structure of the pump 16 is a well-known structure, and the explanation is omitted. However, the pump 16 sucks in no air from the outside even when the contained material is discharged in response to a pressing operation of the head portion 16*a*. As described below, the discharge of the contained material causes the container space inside the container body 12 to become negative pressure, and the piston 20 slides up inside the container body 12.

Figure 3:
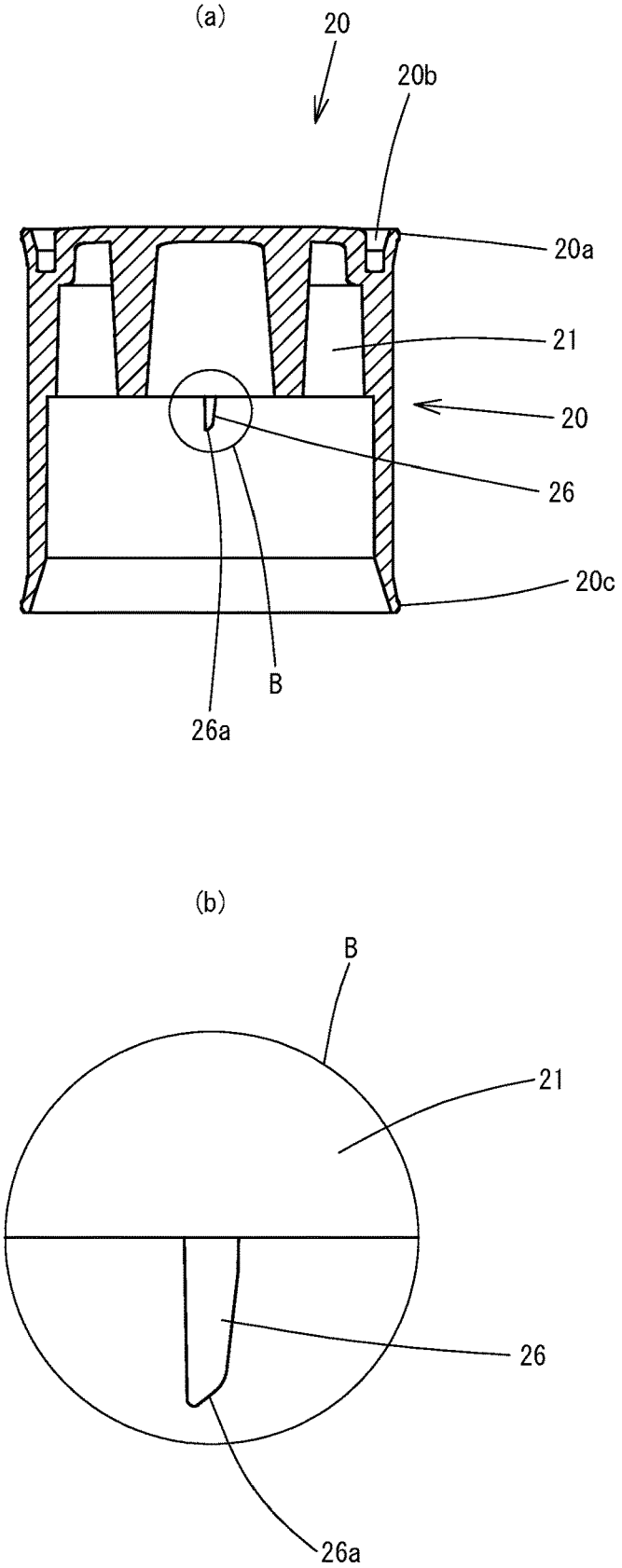
FIG. 3A is a cross-sectional view taken along line A-A in FIG. 2.
FIG. 3B is an enlarged view of part B.

The piston 20 is integrally formed with the bottom lid 22 in a cylindrical shape with a material relatively softer than the material of the bottom lid 22, and is slidable in close contact with the inner circumferential surface of the container body 12 in an airtight state. A suitable material for the piston 20 is, for example, polyethylene or the like. At the upper edge portion of the piston 20, a contact edge portion 20*a* in close contact with the inner circumferential surface of the container body 12 is formed via an annular groove 20*b*. A contact edge portion 20*c* that is in close contact with the inner circumferential surface of the container body 12 is disposed at the lower end edge. As illustrated in FIG. 3, the outer diameters of the contact edge portions 20*a* and 20*c* of the upper and lower end edges spread laterally before being fitted into the container body 12, and is slightly larger than the inner diameter of the container body 12. As a result, the piston 20 inserted into the container body 12 is airtightly pressed against the inner wall surface of the container body 12, and serves as a partition wall separating the container space inside the container body 12 and the external atmosphere below the piston 20.

In the piston 20, a suction port accommodating portion 24 into which the suction port 16*b* at the bottom of the pump 16 is inserted is formed concentrically with the piston 20 from the contact edge portion 20*a* at the upper edge portion through the groove 20*b* to the central portion side. The suction port accommodating portion 24 has a bottomed shape so as to be able to store the liquid in the container portion inside the container body 12. Therefore, when the piston 20 rises to the upper limit, the suction port 16*b* is positioned at the bottom of the suction port accommodating portion 24. As a result, the airless container 10 can suck the liquid and the like, which is the contained material, without leaving any residue.

Figure 4:
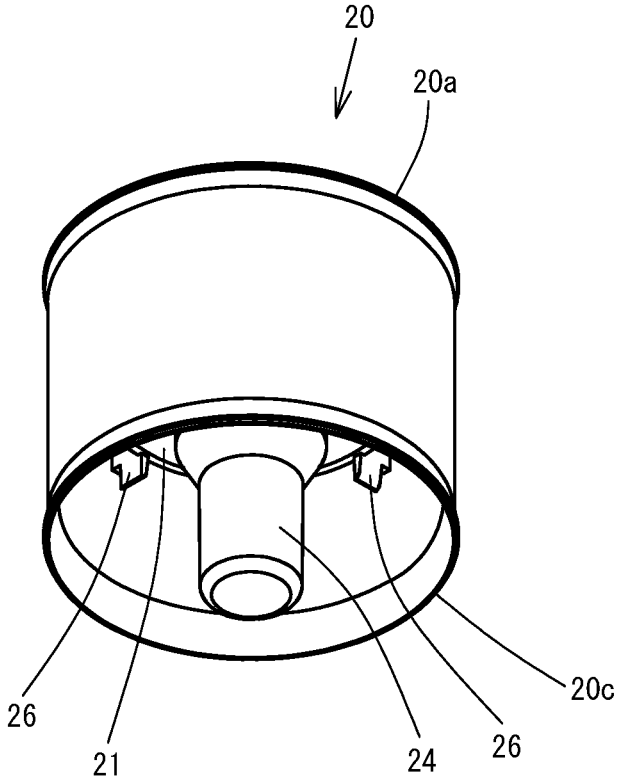
FIG. 4 is a perspective view of the piston of the airless container of the embodiment as viewed from below.
Figure 5:
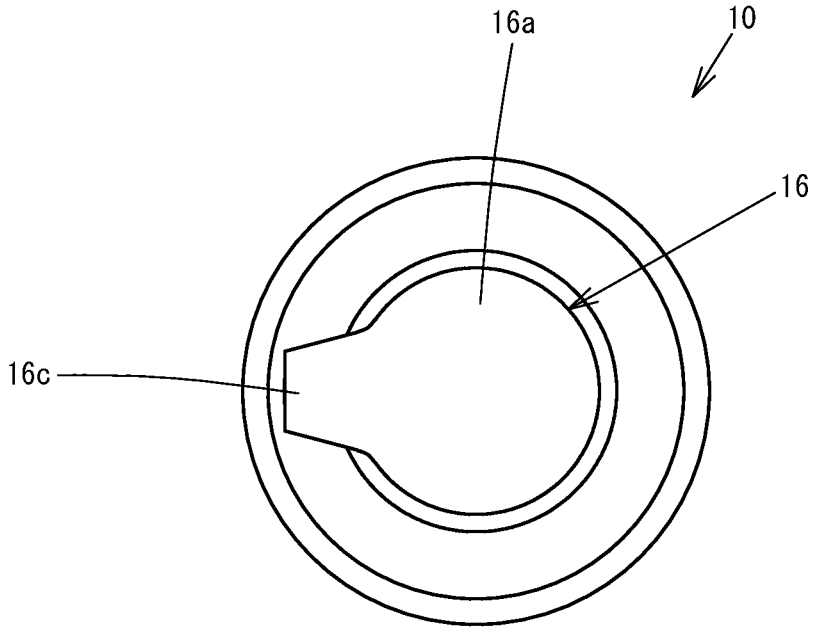
FIG. 5 is a plan view of the airless container of the embodiment.
Figure 6:
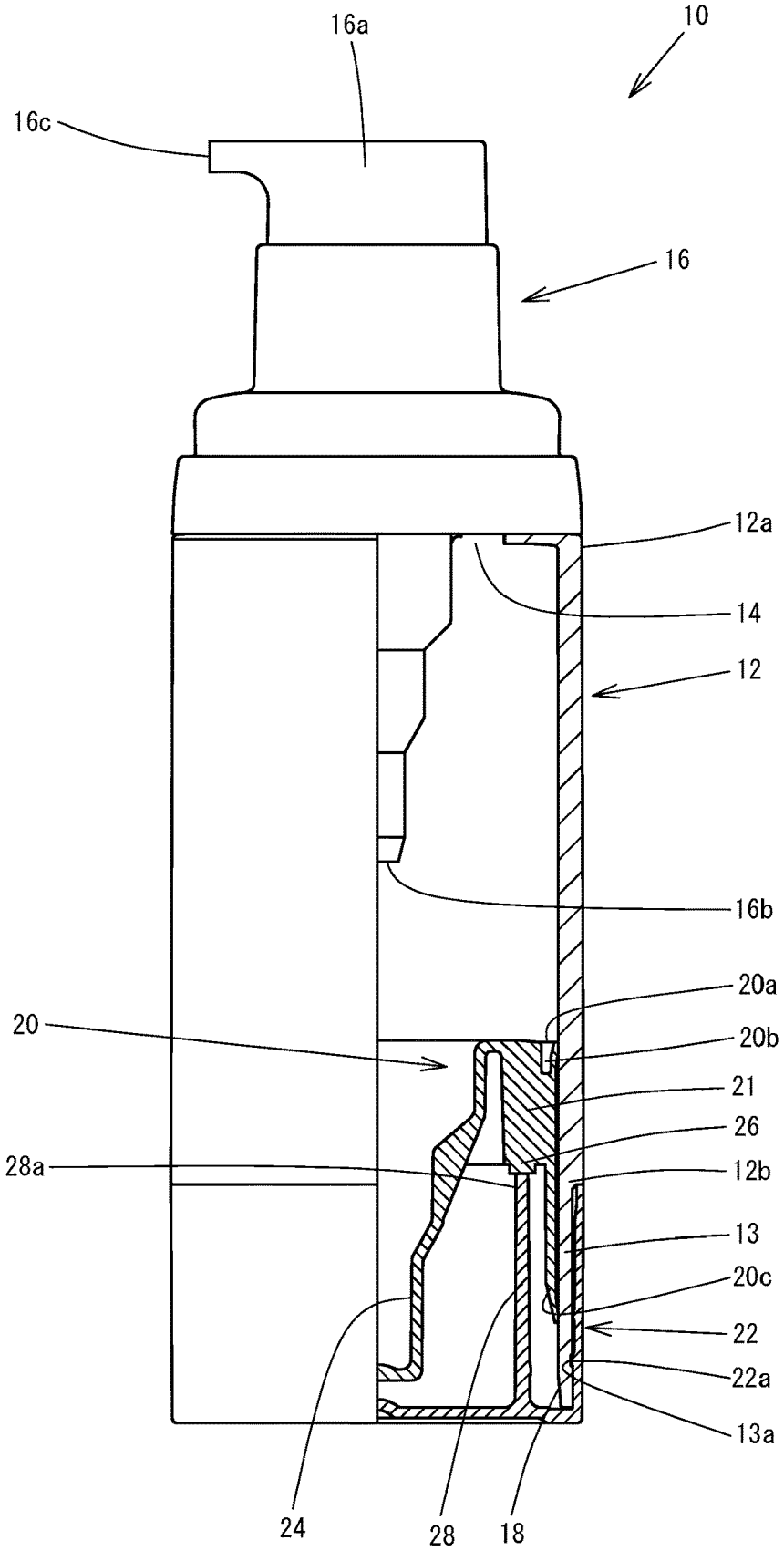
FIG. 6 is a partially cutaway front view of the piston of the airless container of the embodiment in a pressed state.
Figure 7:
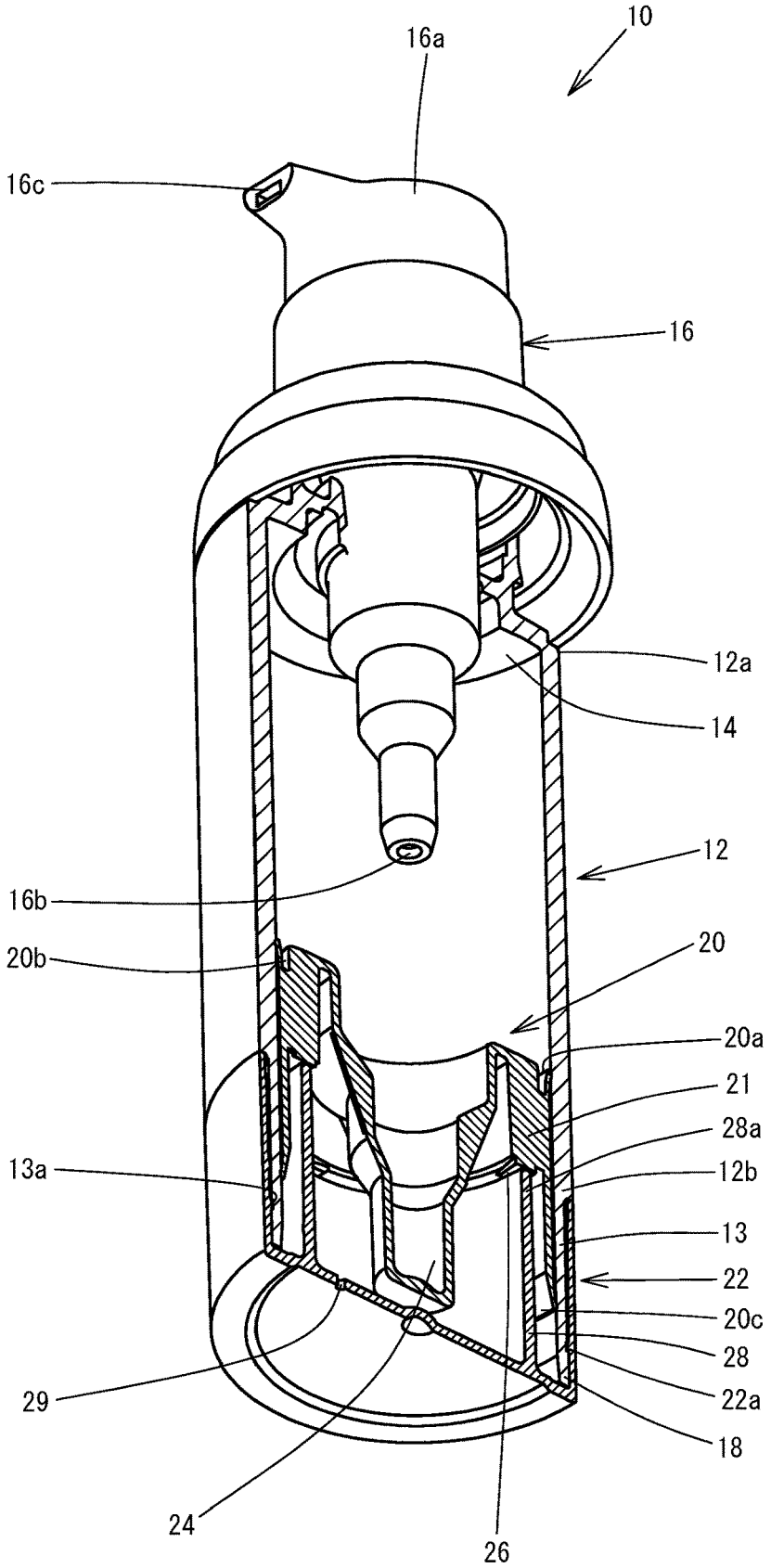
FIG. 7 is a partially cutaway perspective view of the piston of the airless container of the embodiment in a pressed state.
Figure 8:
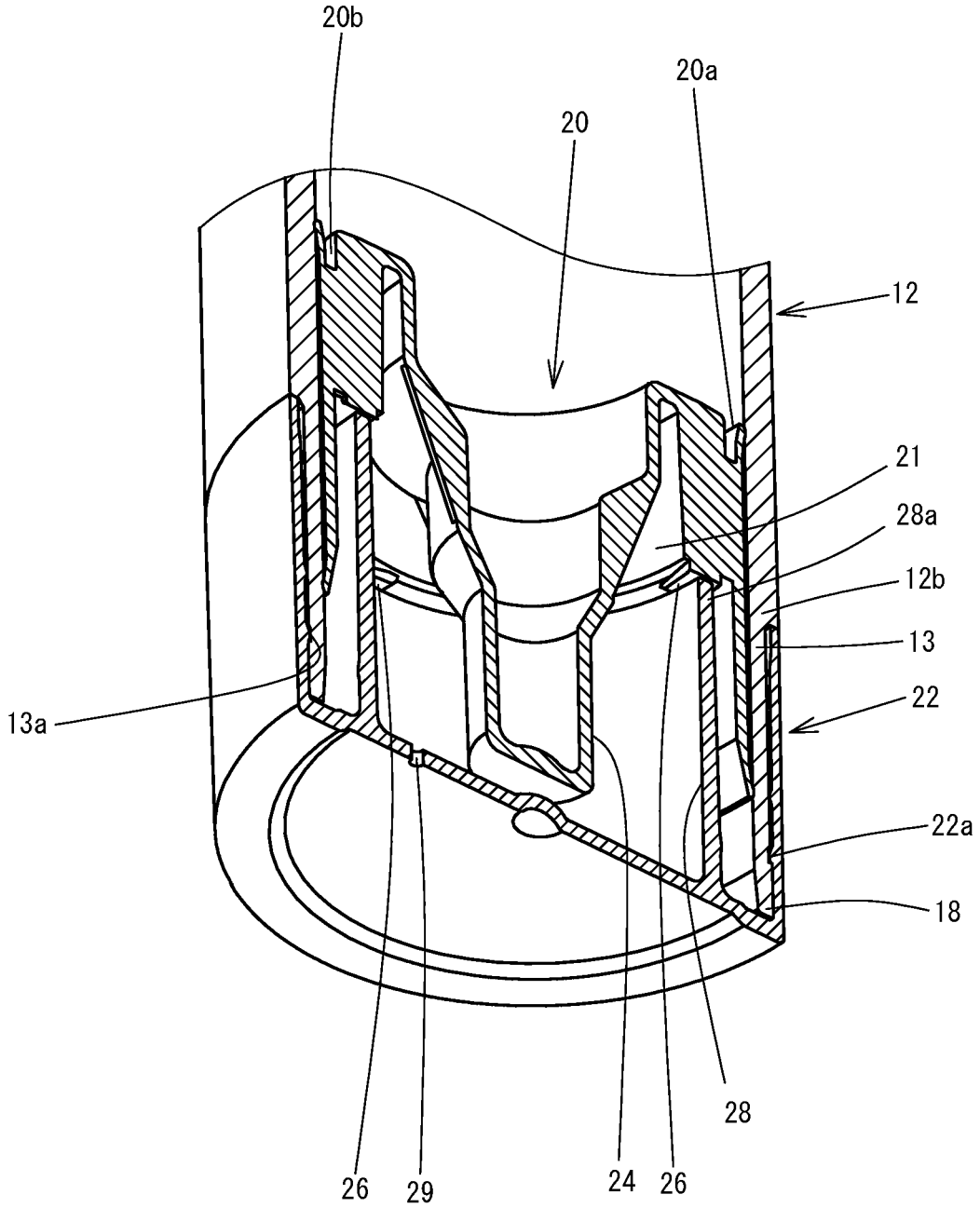
FIG. 8 is an enlarged partially cutaway perspective view of a container bottom portion of the airless container illustrated in FIG. 7.
Figure 9:
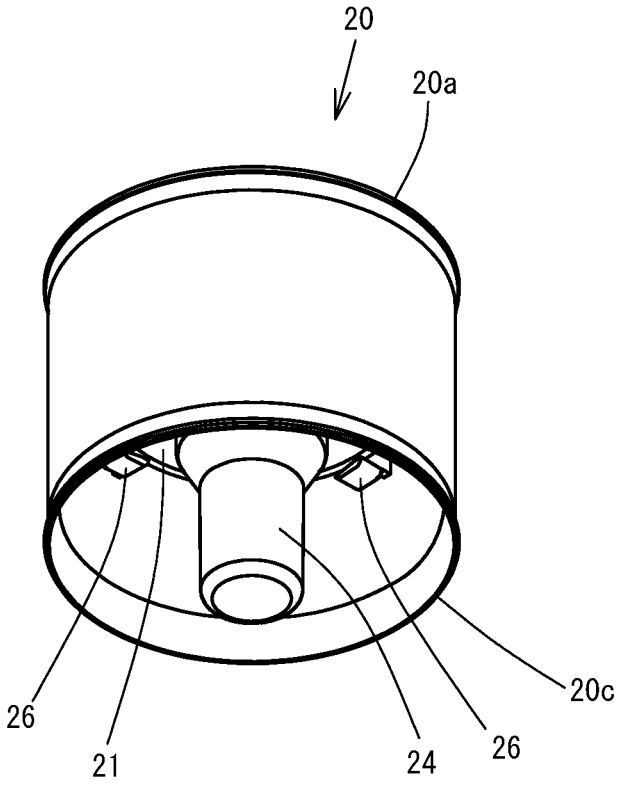
FIG. 9 is a perspective view of the piston of the airless container illustrated in FIG. 7 as viewed from below.

As illustrated in FIGS. 1, 3, and 4, an inner circumferential wall 21 that has a large thickness protruding radially inward is disposed below the groove 20*b* along the entire circumference of the inner wall of the piston 20 on the slightly inner side of the annular groove 20*b* of the piston 20. The length of the inner circumferential wall 21 in the height direction is approximately one-half of the length of the piston 20 in the height direction.

Flexible pieces 26, which are elastically deformable portions, are disposed at the lower edge of the inner circumferential wall 21 inside the piston 20. The flexible pieces 26, which are deformable portions, are positioned on the piston 20 adjacent to the bottom lid 22 and are integrally molded, with the same material as the piston 20.

The length of each of the flexible pieces 26 illustrated in FIG. 1 is 2.5 mm, but it can be changed as appropriate, for example, to 5 mm. In the airless container of the present invention, the length of each of the flexible pieces is preferably within the range of 0.1 to 20 mm, inclusive, and more preferably 1 to 10 mm, inclusive. As mentioned above, the piston 20 is composed of a material that is relatively softer than that of the bottom lid, and the flexible pieces 26 are integrally molded, with the same material as the piston 20. The flexible pieces 26 project from the inner circumferential wall 21 of the piston 20 toward the bottom lid and are disposed at four positions on the same circumference at 90° intervals.

The deformable portions including the flexible pieces 26 are disposed on the piston 20 adjacent to the bottom lid 22, and are portions having a shape capable of flexing against the sliding of the piston 20 toward the bottom lid 22 due to an increase in internal pressure or the like. The flexible pieces 26, which are deformable portions, elastically flex. Furthermore, the flexible pieces 26 do not fit or adhere to the bottom lid 22. Therefore, the flexible pieces 26, which are the deformable portions, do not affect the sliding of the piston 20.

The flexible pieces 26 abut on a support wall 28 of the bottom lid 22, and flex and deform against the sliding of the piston 20 toward the bottom lid 22, so as to prevent the bottom lid 22 from being removed. Furthermore, as illustrated in FIG. 3, tip portions 26*a* of the flexible pieces 26 are each formed to have a surface tilting by 90° or less relative to a contact portion that is an upper edge 28*a* of the support wall 28 of the bottom lid 22, so that the tip portion 26*a* is formed into a shape that readily tilts in one direction when the tilting surface of the tip portion 26*a* slides in contact with the upper edge 28*a* of the support wall 28.

The bottom lid 22 is composed of a material, such as polypropylene, which is relatively harder than the material of the piston 20. The bottom lid 22 has a shape of a bottomed cylinder in which the inner diameter fits with the outer circumferential surface of the fitting recess 13 formed on the entire circumference of the container bottom portion 12*b*. A fitting protrusion 22*a* is disposed in an annular shape at a predetermined position on the inner circumferential surface of the bottom lid 22, and is able to fit into a fitting groove 13*a* formed along the entire circumference of the fitting recess 13 of the container body 12 at the lower edge side.

The support wall 28 having a constant height and cylindrical shape is disposed concentrically inside the bottom lid 22 having a shape of a bottomed cylinder. The support wall 28 is formed in a concentric cylindrical shape at a certain distance from the bottom lid 22 so that the fitting recess 13 of the container body 12, the side circumferential surface of the piston 20, and the contact edge portion 20*c* can be inserted to the outside of the support wall 28. The upper edge 28*a* of the support wall 28 is positioned at a certain height from the lower opening portion 18 of the container body 12. The tip portion 26*a* of each flexible piece 26 of the piston 20 abuts the upper edge 28*a* to position the piston 20. The bottom lid 22 has a through-hole 29 on the bottom surface for communication between the space on the bottom lid side of the piston 20 and the external atmosphere.

The assembly of the airless container 10 according to an embodiment of the present invention will now be described. First, the piston 20 is disposed facing the lower opening portion 18 of the container body 12 and inserted so that the recess of the suction port accommodating portion 24 of the piston 20 faces the suction port 16*b* of the pump 16. The piston 20 is positioned in the container body 12 at an insertion position determined by the bottom lid 22 that is subsequently fitted.

The bottom lid 22 and the container body 12 are fitted to each other by disposing the opening portion side of the bottom lid 22 facing the lower opening portion 18 of the container body 12 and then covering the fitting recess 13 with the bottom lid 22. At this time, the upper edge 28*a* of the support wall 28 of the bottom lid 22 abuts the tip portions 26*a* of the flexible pieces 26 of the piston 20 and pushes up the piston 20 to a predetermined position as the bottom lid 22 is inserted. Since the piston 20 slides in the container body 12 without large resistance, the tip portions 26*a* of the flexible pieces 26 do not flex when the bottom lid 22 is being fitted. With the bottom lid 22 fitted to the container body 12 and the lower opening portion 18 of the container body 12 abutting the inner bottom surface of the bottom lid 22, the fitting protrusion 22*a* on the inner circumferential surface of the bottom lid 22 engages with the fitting groove 13*a* of the fitting recess 13 of the container body 12, and the bottom lid 22 is fixed to the fitting recess 13 of the container body 12.

Next, the container space in the container body 12 is filled with a contained material, such as a liquid, and the pump 16 is fitted and fixed to the upper opening portion 14 of the container body 12. At this time, it is preferred that the container space in the container body 12 be completely filled with the contained material, but it is difficult to completely fill the container due to manufacturing efficiency, and a slight void remains. With the container space being filled with the contained material, the ratio of the void to the maximum volume of the container space (void ratio) is preferably as small as possible. This is because, as described below, when the void ratio is high, the piston 20 is readily pushed down due to the expansion of the contained material, air, and vaporized gas inside the container body 12, and the bottom lid is likely to be removed. Note that the void ratio is preferably 20% or less, more preferably 10% or less. It is more preferably 7% or less, and even more preferably 5% or less. Note that the airless container 10 of an embodiment of the present invention has a void ratio that does not change before and after use (when the contained material is discharged by the pump 16 and the piston 20 slides) because no air enters the container body 12 during use.

The airless container 10 assembled as described above is shipped after the container body 12 has been filled with the contained material, the upper opening portion 14 has been closed by the pump 16, and the container body 12 has been packaged. The functions of the airless container 10 of this embodiment during use will now be described.

When the airless container 10 filled with the contained material is exposed to high temperatures of room temperature or higher for a certain period of time while being distributed and stored, a portion of the contained material in the container body 12 vaporizes and causes an increase in the internal pressure, and the contained material thermally expands to also increase the internal pressure. When the internal pressure inside the container body 12 becomes high, the piston 20 receives a force in the downward direction toward the lower opening portion 18 of the container body 12, and the upper edge 28*a* of the support wall 28 of the bottom lid 22 receives the force from the piston 20. However, since the fitting protrusion 22*a* of the inner circumferential surface of the bottom lid 22 engages with the fitting groove 13*a* of the fitting recess 13 of the container body 12 to fix the bottom lid 22 to the container body, the bottom lid 22 does not readily move and the piston 20 slightly moves toward the bottom lid 22 only causing elastic deformation of the flexible pieces 26.

When the pressure inside the container body 12 rises more due to a temperature rise or the like, the piston 20 is further pushed down toward the lower opening portion 18 of the container body 12. Due to the sliding of the piston 20, the tip portions 26*a* of the flexible pieces 26 press against the upper edge 28*a* of the support wall 28 of the bottom lid 22. Since the tip portions 26*a* come into contact with the upper edge 28*a* of the support wall 28 on a tilting surface of 90° or less, the tip portions 26*a* of the flexible pieces 26 flex so as to face the upper edge 28*a* of the support wall 28, as illustrated in FIGS. 6 to 9.

When the internal pressure rises more and the piston 20 is pushed down, the flexible pieces 26 elastically deform and flex so as to be bent. In this way, when the piston 20 is pushed down toward the lower opening portion 18 of the container body 12 due to an increase in pressure inside the container body 12, the volume of the container space inside the container body 12 increases. Consequently, the increase in the internal pressure is suppressed, and the bottom lid 22 does not receive an excessive force from the piston 20 and thus is not removed from the container body 12. When the temperature of the external atmosphere decreases, the internal pressure inside the container body 12 decreases, and the volume of the contained material or gas decreases. As a result, the inside of the container body 12 becomes negative pressure, and the piston 20 is pushed up.

In the airless container 10 of this embodiment, the piston 20 having the flexible pieces 26 having the tip portions 26*a* having tilting surfaces causes the members on the piston 20 to face the bottom lid 22 from a certain distance, and the piston 20 slides toward the bottom lid. This causes an increase in the volume of the container space, and thereby suppresses the increase in internal pressure. As a result, the members on the piston 20 do not fit or adhere to the bottom lid 22. Moreover, the high fitting strength between the container bottom portion 12*b* of the container body 12 and the bottom lid 22 prevents the bottom lid 22 from readily being removed by an increase in the internal pressure due to a temperature rise of the container or an external impact. Furthermore, since the piston 20 is composed of a material that is relatively softer than the material of the bottom lid 22, the airtightness and liquid-tightness are high, and the flexible pieces 26 deform when the internal pressure increases, the load applied to the bottom lid 22, the piston 20, etc., is reduced. The flexible pieces 26 that are integrally molded with the piston 20 constitute the deformable portions; the flexible pieces 26 readily deform; and the piston 20 is readily slidable in the direction toward the bottom lid 22. As a result, the force applied to the bottom lid 22 is absorbed; an increase in the internal pressure inside the container body 12 is suppressed; and the bottom lid 22 is prevented from being removed. Note that the phrase the "removal of the bottom lid 22" refers not only to the bottom lid 22 that has completely fallen off from the container body 12, but also a state in which the bottom lid 22 has not completely fallen off, but the container body 12 and the bottom lid 22 are inadequately fitted together.

Figure 10:
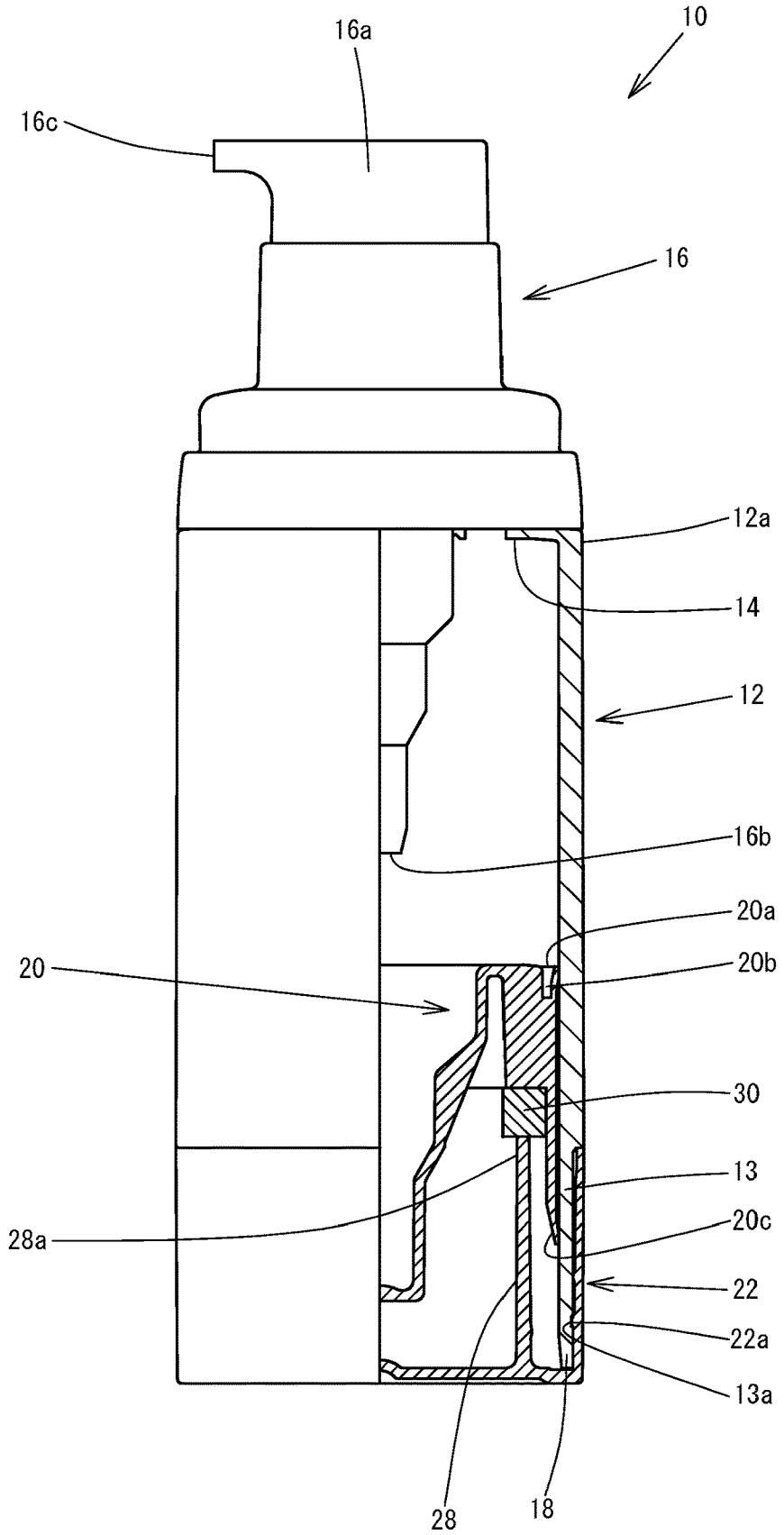
FIG. 10 is a partially cutaway front view of an airless container according to another embodiment of the present invention.

The airless container of the present invention is not limited to the airless container 10 described in the above embodiments. For example, in place of the flexible pieces 26, elastic bodies 30 that are deformable portions separate from the piston 20 may be disposed on the same circumference at regular intervals between the lower edge of the inner circumferential wall 21 of the piston 20 and the upper edge 28*a* of the support wall 28 of the bottom lid 22, as illustrated in FIG. 10. For example, a single circular elastic body may be disposed on the piston adjacent to the bottom lid. The material and shape of the elastic bodies 30 are not particularly limited as long as the elastic bodies 30 are composed of a material that is relatively softer than the material of the bottom lid 22 and do not fit or adhere to the bottom lid 22. As the material of the elastic bodies 30, various resins, metals, etc., can be selected as appropriate.

By providing the elastic bodies 30, which are members separate from the piston 20, a deformable portion that supports higher pressure can be formed.

EXAMPLES

The airless container of the present invention will now be described in comparison with a conventional airless container. In the following tests 1 and 2, a gel containing 70% or more of ethanol, which is a volatile solvent, (hereinafter referred to as a test preparation) was prepared, and the airless container of the present invention illustrated in FIG. 1 was used (the container including flexible pieces each having a length of 2.5 mm). At the same time, the airless container of another embodiment of the present invention (the container including flexible pieces having a length of 5.0 mm) and a conventional airless container were used. Note that, each container had the same container space in which the diameter of the container body was 41 mm, and the maximum volume of the container space was 53 mL.

<Test 1>

For the airless container of the present invention, the test preparation, which is the contained material, was filled in the container while the piston was in contact with the bottom lid (that is, when the container space was the maximum volume). The conventional airless container of the comparative example was also filled with the contained material in the same manner.

The void ratio was 5% or less in each container. Four samples of the airless container of the present invention and four samples of the conventional airless container were stored in an environment of 60° C. for three weeks. The values in Table 1 indicate the number of samples in which removal of the bottom lid was not confirmed in each of the four samples.

TABLE 1

| | Length of Flexible Piece | At Test Start | Day 1 | Day 4 | Week 1 | Week 2 | Week 3 |
|---|---|---|---|---|---|---|---|
| Conventional Airless Container | 0 | 4/4 | 0/4 | 0/4 | 0/4 | 0/4 | 0/4 |
| Airless Container of Present Invention | 2.5 mm | 4/4 | 4/4 | 4/4 | 4/4 | 4/4 | 3/4 |
| | 5 mm | 4/4 | 4/4 | 4/4 | 4/4 | 4/4 | 4/4 |

As shown in Table 1, in the case of the conventional airless container, removal of the bottom lid was confirmed in all samples after one day in an environment of 60° C. In contrast, in the case of the airless containers of the present invention including flexible pieces of 2.5 mm, it was confirmed that the bottom lids were not removed after two weeks. As a result, it was found that the bottom lid of the airless container of the present invention was not removed for a long period of time even under an environment in which the bottom lid of the conventional airless container is removed.

The bottom lids of the airless containers of the present invention having flexible pieces of 5 mm were not removed for three weeks or more. That is, it was confirmed that the effect of preventing the bottom lid from being removed is higher with longer flexible pieces because the cushioning performance is higher.

<Test 2>

In general, when a liquid containing a solvent having high volatility or thermal expansion is the contained material, the larger the void ratio, the easier the internal pressure rises, and the easier it is for the bottom lid to be removed.

The present invention is also effective for a case in which the void ratio in the container is high. Tables 2 and 3 show comparisons of conventional airless containers having a void ratio of 5% or more and airless containers of the present invention (the airless container illustrated in FIG. 1) with the same test preparation as in Test 1 under the same conditions (environmental temperature of 60° C.). The values in the tables indicate the number of containers in which removal of the bottom lid was not confirmed in each of the three airless containers.

TABLE 2

Comparison of Conventional Airless Container and Airless Container of Present Invention with 6.8% Void Ratio

| | Void Ratio | Length of Flexible Piece | At Start | Day 1 | Day 4 | Week 1 |
|---|---|---|---|---|---|---|
| Conventional Airless Container | 6.8% | None | 3/3 | 0/3 | 0/3 | 0/3 |
| Airless Container of Present Invention | 6.8% | 2.5 mm | 3/3 | 3/3 | 3/3 | 3/3 |

TABLE 3

Comparison of Conventional Airless Container and Airless Container of Present Invention with 9.5% Void Ratio

| | Void Ratio | Length of Flexible Piece | At Start | Day 1 |
|---|---|---|---|---|
| Conventional Airless Container | 9.5% | 0 | 3/3 | 0/3 |
| Airless Container of Present Invention | 9.5% | 2.5 mm | 3/3 | 3/3 |

From the above results, when the void ratio was 5% or more, it was confirmed that all bottom lids of the conventional airless containers were removed within one day, but in the case of the airless containers of the present invention, the bottom lids were not removed for one day or more (Tables 2 and 3). Furthermore, the airless containers of the present invention were effective for a long period of time without any removal of the bottom lids being confirmed even when stored under an environment of 60° C. for one week (Table 2).

DESCRIPTION OF REFERENCE NUMERALS

10 airless container
12 container body
12*a* upper edge portion
12*b* container bottom portion
14 upper opening portion
18 lower opening portion
20 piston
21 inner circumferential wall
22 bottom lid
24 suction port housing
26 flexible piece
26*a* end portion
28 support wall
28*a* upper edge

The invention claimed is:

1. An airless container comprising:

a cylindrical container body that defines a container space for storing a contained material in an airtight state, the contained material being a fluid;

a pump that is attached to an upper edge portion of the container body and is configured to externally discharge the contained material;

a bottom lid that closes an opening in a container bottom portion of the container body; and a piston that is disposed in the container body between the pump and the bottom lid and is slidable in the container space in the container body in an airtight state, wherein:

the bottom lid comprises a support wall that is positioned inside the cylindrical container body and has an upper edge that positioned above a position of the opening in the container bottom portion of the container body;

a deformable portion is disposed on the piston adjacent to the bottom lid, and the deformable portion is operable to come into contact with the bottom lid and is deformable against the sliding of the piston toward the bottom lid;

the piston comprises a material that is softer than a material of the bottom lid, and the deformable portion comprises a plurality of flexible pieces that are integrally molded with the piston and are disposed on a same circumference at equal intervals;

each of the plurality of flexible pieces is configured to tilt in one direction;

a tip portion of each of the plurality of flexible pieces has an end surface that is tilted relative to a vertical direction; and the flexible pieces are configured to elastically bend when the piston is pushed down, such that the tip portions of the flexible pieces flex to the upper edge of the support wall of the bottom lid.

2. The airless container according to claim 1, wherein:

the contained material comprises a liquid or a gel containing a solvent having high volatility or thermal expansion, or a preparation having ester bonds to an active ingredient, a volume of the container space in the container body is within a range of 25 to 100 mL, inclusive, and in a state in which the piston and the pump are attached to the container body and the contained material is stored in the container space, a ratio of a void remaining in the container space in the container body is 10% or less of a maximum volume of the container space.

* * * * *